US006824469B2

(12) United States Patent
Allibhoy et al.

(10) Patent No.: US 6,824,469 B2
(45) Date of Patent: Nov. 30, 2004

(54) SYSTEM AND METHOD FOR AWARDING PRIZES

(75) Inventors: Nizar Allibhoy, Northridge, CA (US); Nicholas Cross Wodtke, Santa Monica, CA (US)

(73) Assignee: Sony Pictures Entertainment, Inc., Culver City, CA (US)

( * ) Notice: Subject to any disclaimer, the term of this patent is extended or adjusted under 35 U.S.C. 154(b) by 179 days.

(21) Appl. No.: 10/134,156

(22) Filed: Apr. 25, 2002

(65) Prior Publication Data

US 2003/0013528 A1 Jan. 16, 2003

Related U.S. Application Data

(60) Provisional application No. 60/288,299, filed on May 3, 2001.

(51) Int. Cl.[7] ..... A63F 9/24

(52) U.S. Cl. ..... 463/40; 340/323 R

(58) Field of Search ..... 725/109–111, 135, 725/141, 105, 106; 340/323 R; 463/9–10, 29, 25, 23, 40–42; 700/91–93; 345/327; 348/13

(56) References Cited

U.S. PATENT DOCUMENTS 5,083,271 A * 1/1992 Thacher et al. ..... 463/29
5,697,844 A * 12/1997 Von Kohorn ..... 463/40
5,779,549 A * 7/1998 Walker et al. ..... 463/29
6,198,509 B1 3/2001 Dougherty et al.

OTHER PUBLICATIONS

The Wink System—www.wink.com; Wink Communications, Alameda California 94501—10 pages from webpage.

TruSync System—www.spiderdance.com—Spiderdance, Inc. 1999–2002—3 pages from webpage.

GoldPocket Interactive—www.goldpocket.com—Goldpocket Interactive 2001 2 pages from webpage.

* cited by examiner

*Primary Examiner*—Mark Sager
(74) *Attorney, Agent, or Firm*—Foley & Lardner LLP

(57) ABSTRACT

A system and method for awarding prizes in a contest consisting of multiple sub-contests in which prizes are awarded to contestants based on the contestants' relative skill, even where some of the sub-contests may be known to some of the contestants in advance of the contest. Points are awarded to contestants for correct responses to the sub-contests. Contestants are ranked by the number of points they were awarded. The number of points awarded in the various sub-contests, or the weighting, causes the ranking to approximately correlate to the contestants' performance on a particular sub-set of the sub-contests. Sub-grouping of contestants and multi-tiered prizing structures are also employed.

34 Claims, 7 Drawing Sheets

SYSTEM AND METHOD FOR AWARDING PRIZES

CROSS-REFERENCE TO RELATED APPLICATIONS

This application claims priority from U.S. Provisional Application Ser. No. 60/288,299, filed May 3, 2001, the contents of which are incorporated by reference. Embodiments of the present invention relate to a U.S. Utility Patent Application entitled "Interactive Broadcast System and Method With Different Content Displayed To Different Viewers," Attorney Docket No. 041892-0219, Ser. No. 10/134203 filed Apr. 25, 2002, the contents of which are incorporated by reference herein.

BACKGROUND

1. Field of the Invention

The present invention relates, generally, to a system and method for awarding prizes in a contest in a manner that is sufficiently based on the relative skill of the contestants rather than on chance, and in particular embodiments, to a system and method for awarding prizes to players of an interactive game show which is based on a pre-recorded game show.

2. Description of Related Art

Prizes may be awarded in contests in a variety of ways. Generally, methods for awarding prizes may be categorized as a sweepstakes or a game of skill. In a sweepstakes, winners of the contest are determined based on chance. An example of a sweepstakes is a lottery. There is no skill involved in a lottery because winners are determined randomly or by chance. Conversely, in a game of skill, prizes are awarded generally based on the relative skill of the contestants.

For an entity hosting a contest, while it may be important to choose a prizing structure that entices people to participate in the contest, certain prizing structures may be illegal. For example, laws in some jurisdictions may restrict contests with certain types of prizing structures in which the outcome is determined based on chance. In particular, some jurisdictions may restrict chance-based contests in which contestants pay a fee to enter to the contest and where prizes are awarded in the contest. Thus, for an entity desiring to host a contest on a pay-per-play basis, it may be desirable that the contest not be deemed a game of chance. Accordingly, an entity hosting such a contest may prefer that prizes be awarded in the contest, to an acceptable extent, based on the relative skill of the contestants.

An example of a game of skill may be a television game show. Generally, the contestants on a game show use their skill or knowledge to accumulate points. Such a game show may be deemed a game of skill because the winner is the contestant who accumulates the most skill-based or knowledge-based points. However, if a winner were selected randomly, irrespective of how many points the various contestants had accumulated, then the contest may be deemed a game of chance. Even in a game of skill, however, a certain amount of chance may be involved in selecting a winner. Accordingly, an entity hosting a contest on a pay-per-play basis in which prizes are awarded may need to consider, with reference to the laws of a particular jurisdiction, whether a given contest may be deemed a game of skill or a game of chance.

With the advent of interactive television, a television game show may be created in which viewers may play along with the game show and compete against other viewers. In this context, interactive television generally refers to a configuration in which a viewer is able to receive a television broadcast as well as have access to a return channel. A return channel is a way for a viewer to communicate back to a content provider.

An example of an implementation of a return channel is synchronized television. Companies, including GoldPocket Interactive of Medford, Mass., or Spiderdance, Inc., of Venice, Calif., have developed synchronized television systems (also known as a two-screen experience) in which a viewer may use a personal computer connected to the Internet to view a web-page that is synchronized to a particular pre-recorded television program. Another company, Wink Communications, Inc., of Alameda, Calif., provides viewers with a return channel through a set top box (STB) by way of a modem connected to a telephone line. In a system like the Wink system, a viewer may use a remote control device and a STB to communicate back to a service provider, usually in response to graphics that are displayed on a television screen.

One problem that may be associated with interactive game shows is that a viewer may be able to learn the answers to puzzles in the show before playing the game. For example, because a pre-recorded game show may be broadcast in the same time slot in different time zones, a viewer may have access to the puzzles and the answers to the puzzles before actually viewing the show or playing along with the show. More specifically, a viewer may confer with other viewers located in later time zones who were shown puzzle answers in a previous airing of the show. Similarly, with a digital television recording medium, a viewer may be able to rewind a television program while it is being broadcast to learn the answers. Accordingly, even though television viewers may have access to a return channel through which they may provide responses to game show puzzles, a true skill-based competition has proven elusive.

In some interactive game shows, a content provider may desire to award prizes to viewers who play along with a show in order to entice viewers to continue to watch and play along with the show. A content provider may also desire to charge viewers to play along with a game show (pay-per-play). However, as discussed above, some jurisdictions may restrict the awarding of prizes based on pay-per-play games of chance. If answers to puzzles in a particular game show are sufficiently available before the show is broadcast, then the show may be effectively reduced to a game of chance. If puzzle answers are sufficiently available, then multiple viewers could have all of the correct answers without exhibiting any particular skill and many perfect scores may be achieved without appreciable skill involved.

In co-pending patent application Ser. No. 10/134,203, filed Apr. 25, 2002, Attorney Docket No. 041892-0219, which is incorporated herein by reference, a system and method are disclosed for broadcasting a pre-recorded program with additional content items to give viewers a more individualized experience. In the context of an interactive game show, for example, a viewer may play along with the contestants on a pre-recorded program and intermittently respond to additional individualized bonus puzzles presented during the program. The individualized bonus puzzles may be unavailable (or not sufficiently available) to individual viewers in advance of an airing or viewing of the game show. In this manner, viewer answers to bonus questions are more likely skill-based than chance-based. However, if prizes are awarded based only on a viewer's responses to the bonus puzzles, then a viewer's interest in the game may diminish.

SUMMARY OF THE DISCLOSURE

Therefore, it is an advantage of embodiments of the invention that a system and method for awarding prizes in a contest may result in a contest being deemed a game of skill, even where the contest includes some sub-contests that may have been available to contestants before the contest is played. In such embodiments, the winners of the contest may be determined sufficiently based on the relative skill of the contestants.

It is a further advantage of embodiments of the invention to provide a system and method for awarding prizes in an interactive game show, while allowing at least some of the effect of real time interactivity to produce a level of excitement and continued motivation to play the game. In embodiments of the invention, viewers may have a sensation of playing along with pre-recorded contestants because parts of the game show may be pre-recorded. A viewer's experience may be enhanced because the viewer may receive points for correctly responding to the pre-recorded puzzles.

It is a further advantage of embodiments of the invention that, even though contestants may be awarded points for responding to pre-recorded puzzles, the contest may still be deemed a game of skill. If a contest is deemed a game of skill, then an entity hosting the contest may be able to charge contestants a certain amount to participate in the contest. In addition, an entity hosting such a contest may be able to award prizes to contestants without the contest being deemed a game of chance.

Embodiments of the invention may be implemented, for example, in the context of an interactive television game show. In an interactive television environment, viewers may have access to a return channel. Therefore, in an interactive game show, viewers may be able to communicate responses to puzzles to a content provider, and to compete with other viewers. Also, in an interactive game show, pre-recorded puzzles may be presented to viewers along with additional bonus puzzles. The bonus puzzles may be sufficiently unique to different viewers such that they are not likely available in advance of the viewer's game playing experience. In an interactive game show embodiment, points may be awarded to viewers for correctly solving both the pre-recorded puzzles as well as the bonus puzzles. It is an advantage of these embodiments that the points awarded may be weighted such that the outcome of the contest sufficiently correlates with the viewers' performance on the bonus puzzles, such that the contest itself may be deemed a game of skill.

In further embodiments of the invention, a multi-tiered prizing structure may be employed. A first tier may be established such that a winner may be determined based on the contestants' relative skill. Other tiers may be added that are based on other criteria. For example, in the case of an interactive game show, a first tier might rank contestants based solely on their responses to the bonus puzzles. A second tier may, for example, rank contestants on other criteria, such as their responses to the pre-recorded puzzles, the time taken to respond to the pre-recorded puzzles, the time taken to respond to the bonus puzzles, or the like. Multiple tiers may be employed and a variety of criteria used.

Also, embodiments of a prizing structure may combine a skill component and a sweepstakes component. For example, a first tier may be established as described above which includes all contestants who score more than a particular number of points. Within the first tier, a winner or winners may be selected pseudo-randomly. An advantage of such embodiments is that an entire group of players may be motivated to continue competing even if they do not believe they are capable of achieving the highest score.

In yet further embodiments of the invention, a group of contestants may be divided into sub-groups and prizes awarded within the various groups. Accordingly, contestants may be divided into sub-groups based on a variety of criteria, including, but limited to, geographic region or time zone, amount paid to play the game, frequency of play, or the like. A prizing structure may be employed within each sub-group so that winners may still be determined sufficiently based on the relative skill of the contestants.

These and other objects, features, and advantages of embodiments of the invention will be apparent to those skilled in the art from the following detailed description of embodiments of the invention, when read with the drawings and appended claims.

BRIEF DESCRIPTION OF THE DRAWINGS

The detailed description of preferred embodiments of the invention will be made with reference to the accompanying drawings wherein.

DETAILED DESCRIPTION OF PREFERRED EMBODIMENTS

The following detailed description is of the best presently contemplated mode of carrying out embodiments of the invention. This description is not to be taken in a limiting sense, but is made merely for the purpose of illustrating general principles of the invention. The scope of the invention is best defined by the appended claims.

The present invention relates to a system and method for awarding contest prizes in a manner that is sufficiently based on the skill of the contestants to characterize the contest as one of skill rather than one of chance. In some embodiments, a system and method for awarding prizes is provided in the context of an interactive game show. In these embodiments, an interactive game show may be based on a pre-recorded game show. Thus, an interactive game show may combine pre-recorded puzzles and additional bonus puzzles. Embodiments of the system and method involve awarding prizes based on contestants' skill, even where certain puzzles in the game show may be available to contestants in advance of the contest.

Figure 1:
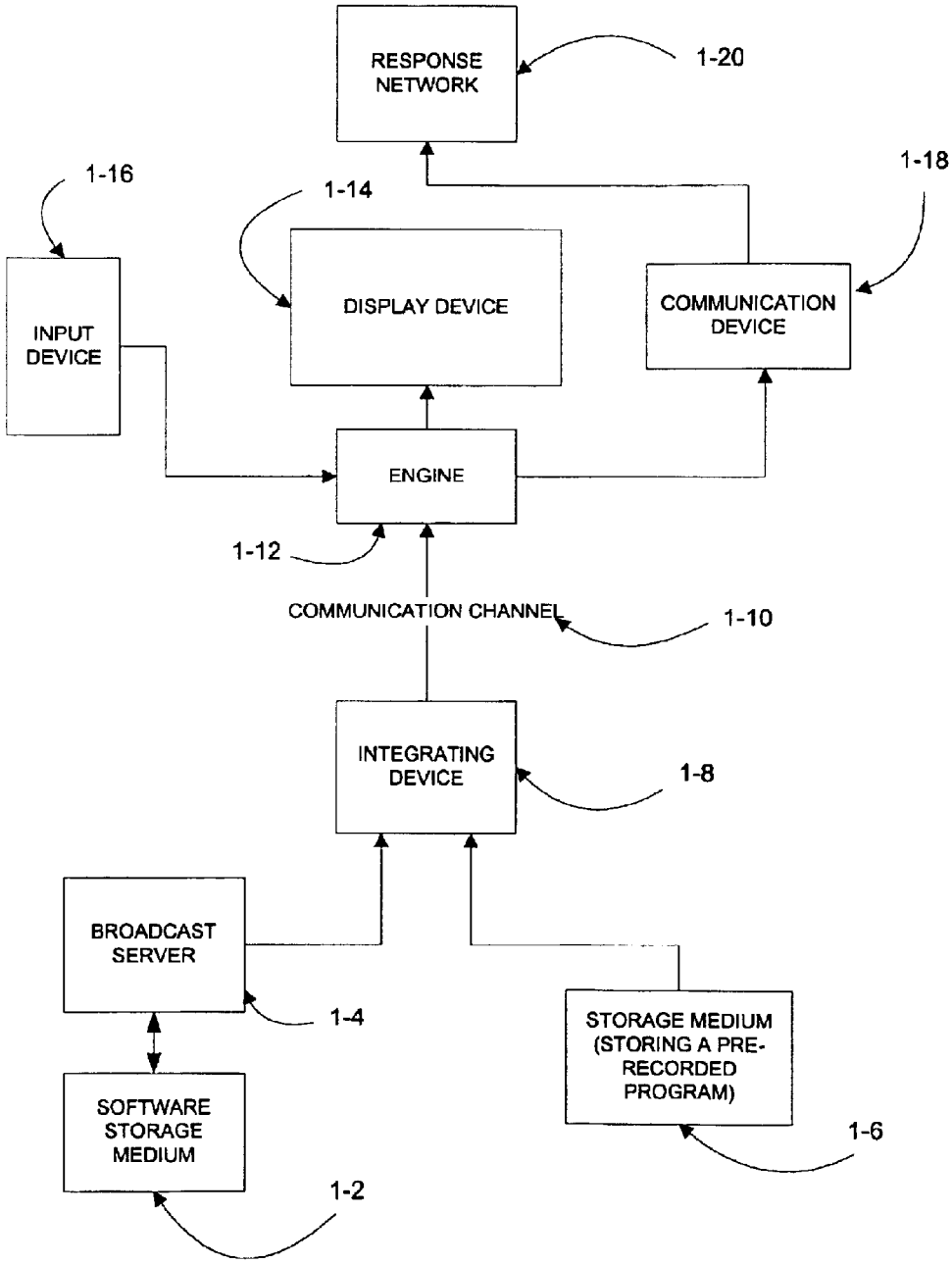
FIG. 1 shows a diagram of a hardware environment of an interactive television system with which embodiments of the invention may be implemented.

Embodiments of the invention may be implemented in a variety of hardware environments. By way of example, FIG. 1 shows a representative hardware environment according to an embodiment of the invention. The hardware environment in FIG. 1 may be described as an interactive television system. A software storage medium 1-2 stores software that works with a broadcast server 1-4 to create an interactive television application. A storage medium 1-6 stores a pre-recorded program and provides the pre-recorded program to an integrating device 1-8 which integrates the interactive television application with the prerecorded program. Following integration, the combined signal is transmitted or broadcast over a communication channel 1-10. In the example hardware environment in FIG. 1, an engine 1-12 receives the transmitted signal. The engine 1-12 may control the display of video on a display device 1-14, accept input from an input device 1-16, and communicate through a communications device 1-18 over a response network 1-20.

In one embodiment, the display device 1-14 comprises a television set, the engine 1-12 comprises a set top box, and the input device 1-16 comprises a remote control device. The input device 1-16 may comprise a keyboard, a computer mouse, a voice recognition and enabling device, or the like. The communications device 1-18 may comprise a modem, a two-way satellite connection, a two-way cable television, or a like communications device. The engine 1-12 may be combined with the display device 1-14 rather than comprising a set top box. In other embodiments, the display device 1-14, the engine 1-12, the input device 1-16, and the communications device 1-18 may comprise components of, for example, a personal data assistant (PDA), a media player, or a personal computer. In addition, the communication channel 1-10 may comprise a conventional television broadcast, cable television, satellite transmission, or other suitable channels of broadcast or transmission.

An example embodiment of the invention is described with reference to an interactive version of the television game show JEOPARDY!®. An interactive game show in the JEOPARDY!® format is described in co-pending patent application Ser. No. 10/134203, filed Apr. 25, 2002, Attorney Docket No. 041892-0219, which is incorporated herein by reference. An interactive game show may combine a pre-recorded game show with additional bonus puzzles that are presented to viewers when the show is broadcast. Other embodiments of the invention may employ other game shows, other interactive television competitions, or other competitions such as video games, sports contests, or the like. Thus, while embodiments are described herein with respect to a JEOPARDY!® game show format, it will be understood that aspects of the invention are not limited to such a format.

A JEOPARDY!® game show format employs a trivia/quiz show format in which three contestants compete to solve puzzles that are assigned different point values. The puzzles are presented to the contestants by a game show host. The point values of the puzzles are awarded to the contestant who correctly solves the particular puzzle. JEOPARDY!® employs an answer/question format in which a puzzle consists of presenting an "answer" to the contestants, with the contestants providing the correct "question" for the answer. Ultimately, the contestant who has accumulated the highest score wins the game. JEOPARDY!® incorporates various nuances into this structure. For instance, the contestants can "bet" on a Double JEOPARDY!® or Final JEOPARDY!® question to increase their chances of winning the game. In the context of conventional television broadcasting, a JEOPARDY!® program is recorded and broadcast to viewers at a later time.

Co-pending patent application Ser. No. 10/134203, filed Apr. 25, 2002, Attorney Docket No. 041892-0219, which is incorporated herein by reference, discloses an example embodiment employing an interactive JEOPARDY!® game show format. In an example embodiment, a pool of bonus puzzles may be broadcast along with a pre-recorded program. Viewers may have the sensation of playing along with the pre-recorded contestants in real time because they may respond interactively to the pre-recorded puzzles. In addition, viewers may be presented with bonus puzzles during the pre-recorded program that may be sufficiently unique to a particular viewer. Specifically, bonus puzzles from the pool may be displayed to viewers during the pre-recorded program (at specified intervals or gaps in the program) such that different bonus puzzles may be presented to different viewers. Thus, embodiments of an interactive game show may give viewers a virtual real-time effect, yet still provide bonus questions to the viewers that are sufficiently unavailable prior to the game. A viewer may have an experience that is different from another viewer's experience because of the addition of the bonus puzzles.

Figure 2:
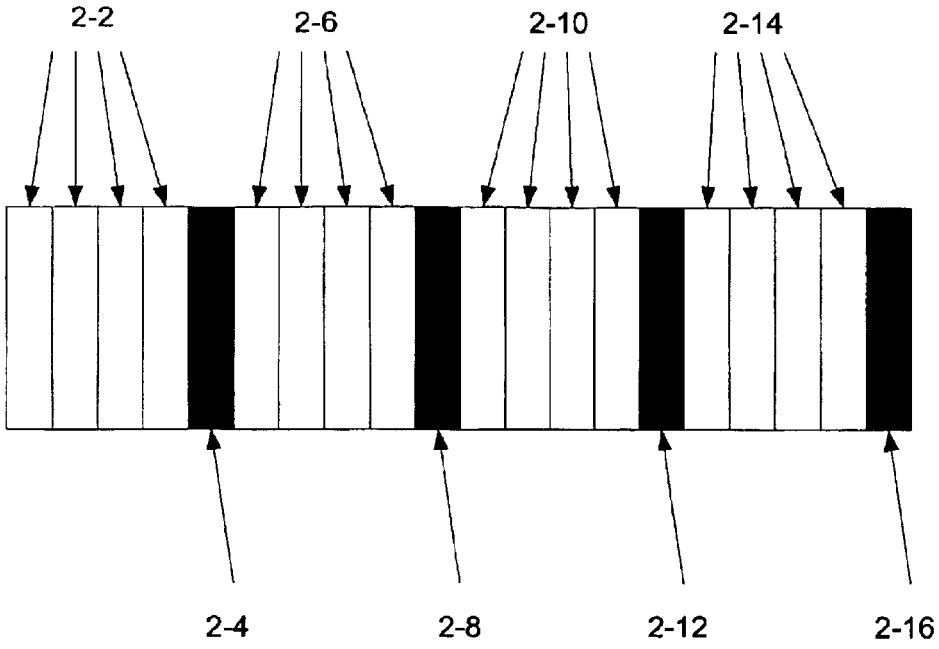
FIG. 2 shows a timeline diagram of a broadcast signal for a game show according to an example embodiment of the invention.

Thus, the flow of an example embodiment employing the format of an interactive JEOPARDY!® game show may proceed as shown in the timeline in FIG. 2. In the example embodiment in FIG. 2, all contestants, including the contestants in the pre-recorded and/or broadcasted game, are presented with a series of puzzles 2-2, 2-6, 2-10, and 2-14, after which specified intervals or a gaps 2-4, 2-8, 2-12, and 2-16 are provided. In the example embodiment, when the show is played or broadcast at a later time, players viewing the later played or broadcast show may be presented with one or more unique (or sufficiently unique) JEOPARDY!®-like puzzles to solve during the specified intervals or gaps 2-4, 2-8, 2-12, and 2-16.

One reason for integrating bonus puzzles into a pre-recorded game show, as in an example embodiment, is to create a game that is sufficiently unique for each viewer such that a viewer is not likely to learn of all of the puzzles or the answers to all of the puzzles before a broadcast of the game. In an example embodiment, a viewer may not learn the answers to all of the puzzles by watching the program twice or by obtaining answers from a viewer who watched the program previously (i.e. in another time zone). Thus, embodiments of an interactive JEOPARDY!® game show may be played by viewers across different time zones, by viewers watching the same program at different times, and by viewers who may rewind the program, without certain viewers having advance knowledge of all of the puzzles. In addition, a viewer may have a sensation of playing along with pre-recorded contestants, because a viewer may score points for correctly solving both pre-recorded puzzles and bonus puzzles.

As discussed above, in example embodiments, it may be advantageous to have winners determined based on the relative skill of contestants rather than on chance so that the contest may not be deemed a game of chance (which may not comply with laws in certain jurisdictions). Indeed, in example embodiments, contests may be provided on a per-pay-play basis and prizes may be awarded. Thus, embodiments of the invention employ prizing structures that determine and award winners based on the relative skill of the contestants to a sufficient degree of certainty to qualify the contest as a game of skill rather than a game of chance. The degree of certainty may vary from jurisdiction to jurisdiction and may be selected in accordance with the contest standards in the jurisdiction in which the contest is played.

In an example embodiment in which a contest is composed of a plurality of sub-contests, with some of the sub-contests being games of skill and some of the sub-contests being games of chance, games of skill may be weighted more heavily than games of chance so that the games of skill sufficiently influence the outcome of the contest. For example, in an interactive JEOPARDY!® embodiment, viewers may be awarded more points for solving a bonus puzzle than for solving a pre-recorded puzzle that was included in the broadcast show. The precise weighting may be adjusted depending on the ratio of pre-recorded puzzles to bonus puzzles. However, in an example embodiment, puzzles are weighted such that an outcome is determined primarily based on responses to bonus puzzles. In a further embodiment, puzzles are weighted such that the outcome is determined entirely based on responses to bonus puzzles.

In an example embodiment, viewers may receive points for correctly solving pre-recorded puzzles as well as for correctly solving bonus puzzles. If points were awarded only for correctly solving pre-recorded puzzles, then the contest may be deemed a game of chance (since the puzzles may be known to contestants prior to the broadcast). If points were awarded only for correctly solving bonus puzzles, then viewers may lack motivation to play along with the pre-recorded portion of the game show and may miss out on the virtual real-time playing experience and excitement. As a result, viewer interest in the entire contest may diminish. Accordingly, embodiments of the invention employ a prizing scheme designed to motivate viewers to play all portions of the contest, yet award prizes sufficiently dependent on the skill-based portions of the contest.

Figure 3:
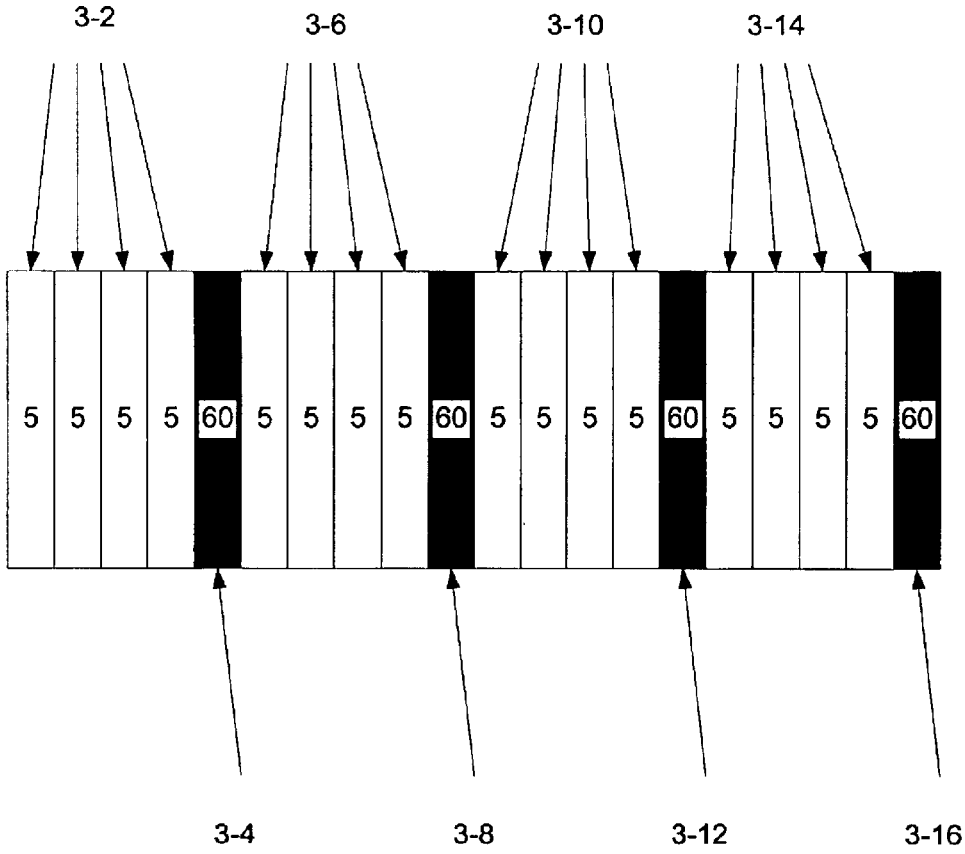
FIG. 3 shows a timeline diagram incorporating point values associated with puzzles for a game show according to an embodiment of the invention.

An example embodiment of the invention is illustrated in FIG. 3. The example embodiment in FIG. 3, employing an interactive JEOPARDY!® format, is composed of 16 pre-recorded puzzles 3-2, 3-6, 3-10, and 3-14, and four bonus puzzles 3-4, 3-8, 3-12, and 3-16. In the example embodiment in FIG. 3, a viewer may be awarded 5 points for correctly solving a pre-recorded puzzle and 60 points for correctly solving a bonus puzzle. Thus, in this example embodiment, a viewer could score up to 80 points for correctly solving all of the pre-recorded puzzles and 240 points for correctly solving all of the bonus puzzles.

In the example embodiment in FIG. 3, prizes may be awarded to the viewer or viewers receiving the most points. In this embodiment, the winners of the contest will generally be viewers who perform best on the bonus puzzles because of how the puzzles are weighted. Even if answers to all the pre-recorded puzzles are available before a broadcast, the pre-recorded puzzles will not generally determine the outcome of the contest, as long as at least one viewer answers two or more bonus puzzles correctly. Similarly, if multiple viewers answer all of the pre-recorded puzzles correctly, then as long as one of those viewers answers at least one bonus puzzle correctly, then the bonus puzzles again determine the outcome. Other embodiments of the invention may employ different point values or puzzle ratios depending on the desired outcome. In addition, jurisdictions may have different requirements concerning to what degree of certainty the outcome of a contest must be based on skill rather than chance (i.e. for jurisdictions that restrict or regulate games of chance). Point values associated with different puzzles may be varied to account for the requirements of a particular jurisdiction.

Figure 4:
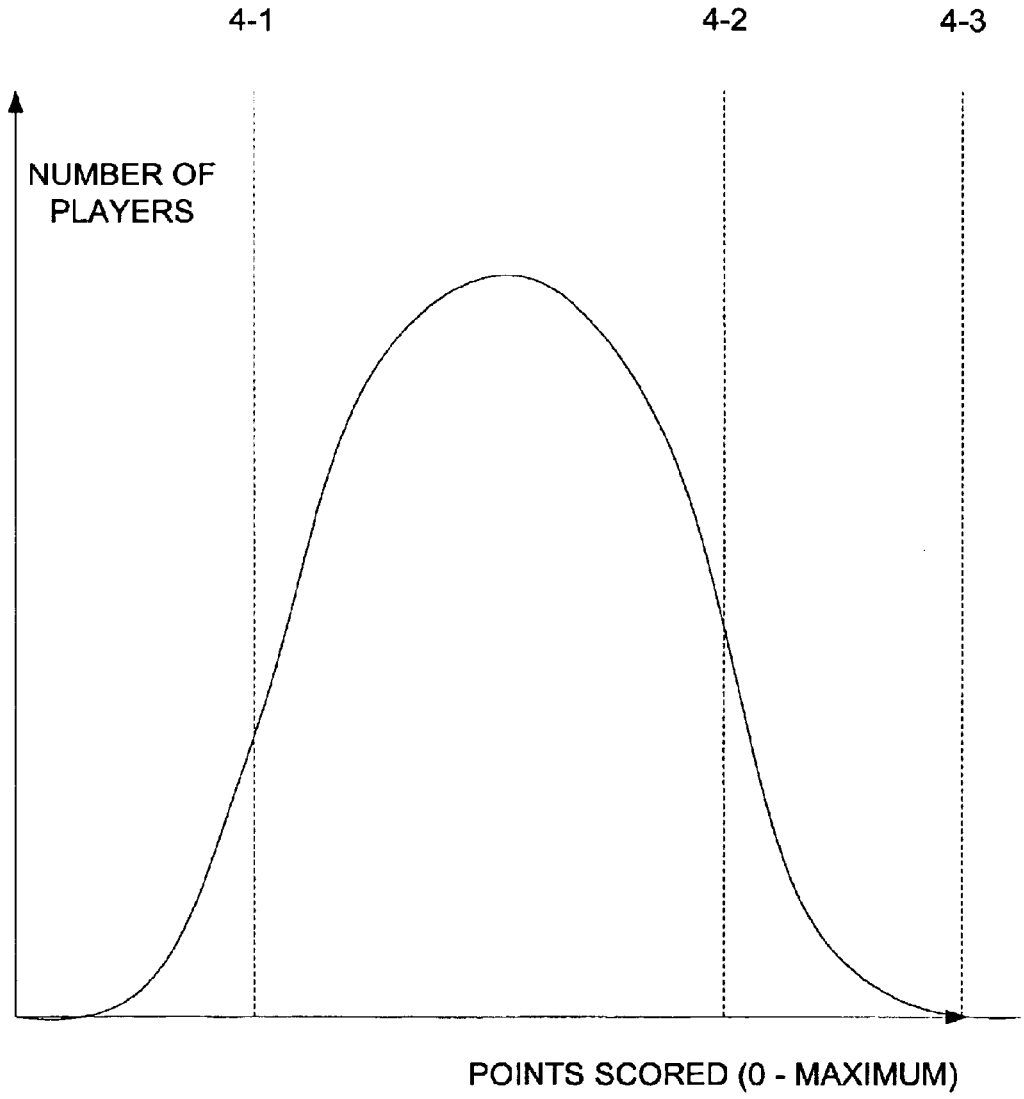
FIG. 4 shows a graph of a scoring distribution for a contest in accordance with an example embodiment of the invention.

FIG. 4 illustrates a prizing structure in an example embodiment that determines and awards winners, to a sufficient degree of certainty, based on the skill of the players. FIG. 4 shows a distribution of scores in an example interactive JEOPARDY!® embodiment. Viewers' scores are reflected on the horizontal axis and the number of players is reflected on the vertical axis. A bell curve may illustrate the score distribution. Line 4-1 in FIG. 4 shows the maximum number of points a viewer may receive in an example embodiment for correctly solving pre-recorded puzzles. Accordingly, even if a viewer obtains answers to all of the pre-recorded puzzles before the contest, that viewer will not likely achieve a high enough score to win a prize unless the viewer also answers one or more bonus questions correctly. Since the bonus questions require skill, winners may be determined sufficiently based on the contestants' relative skill.

Line 4-2 in FIG. 4 reflects the maximum number of points a viewer could receive for correctly solving all of the bonus puzzles (without solving any pre-recorded puzzles). If only the viewers' scores on the bonus puzzles were considered in selecting prize winners, then the contest should generally be deemed a game of skill. However, if viewers learned that they did not need to solve the pre-recorded puzzles to win a prize, then viewer interest in those puzzles may diminish and motivation to play the game may diminish. Accordingly, in an example embodiment, points are awarded for correctly solving pre-recorded puzzles and bonus puzzles. Therefore, prizes may be awarded to the highest scorers who fall between line 4-2 and line 4-3 (where line 4-3 reflects a perfect score). It may be an important part of a viewer's experience that the viewer has a sensation of playing along with pre-recorded contestants. Thus, an example embodiment has an advantage of maintaining viewer interest in the game show by awarding points for correctly solving pre-recorded puzzles, while still determining prizes and winners, to a sufficient degree of certainty, based on the skill of the viewers.

Further embodiments may employ multi-tiered prizing structures. These embodiments are also described in the context of an interactive game show, as illustrated in FIGS. 2 and 3. In an embodiment employing a multi-tiered prizing structure, prize categories may be established based on various criteria. For example, an initial tier for prizing purposes may be viewers' scores on the bonus puzzles. In such an embodiment, the initial tier alone may sufficiently qualify the game as one of skill rather than chance because the pre-recorded puzzles are not considered in awarding prizes. In further embodiments, additional tiers could be added to a prizing structure.

Figure 5:
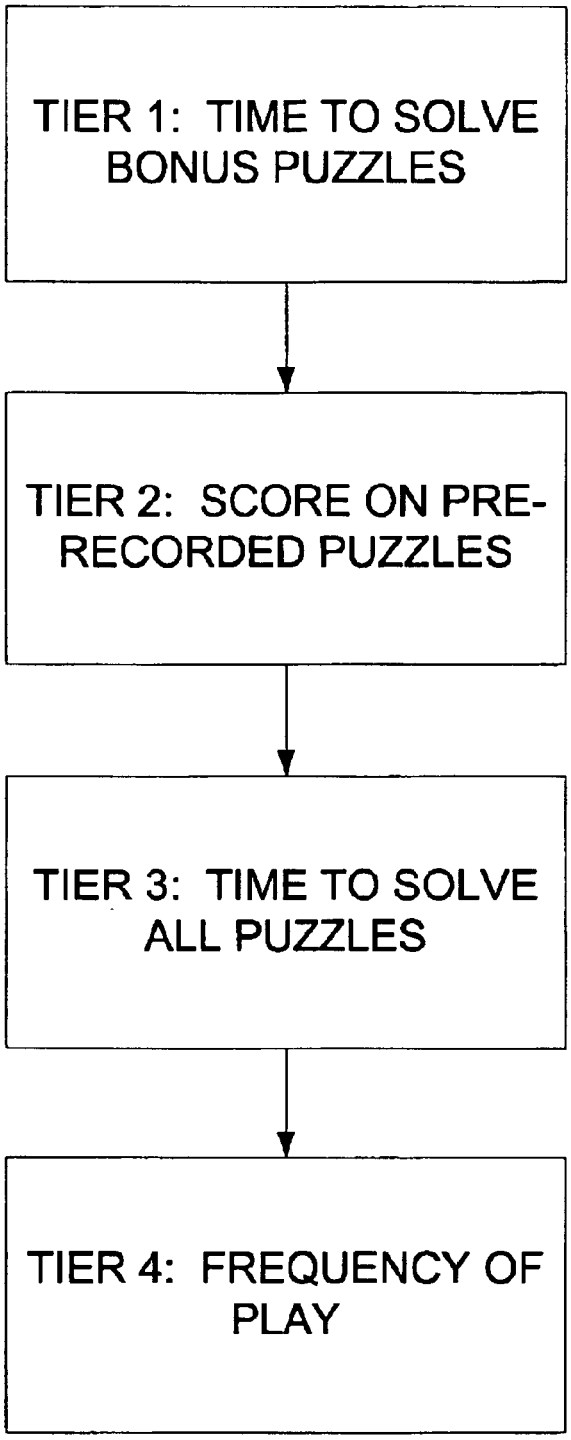
FIG. 5 shows a multi-tiered prizing structure according to an embodiment of the invention.

For example, if multiple viewers in the first tier receive the highest score, tie-breaking tiers may be employed. An example embodiment employing a multi-tiered tie-breaking prizing structure is illustrated in FIG. 5. An embodiment illustrated in FIG. 5 employs tie-breaking tiers in which successive ties are broken according to: (1) the amount of time taken to solve the bonus puzzles, (2) the score on the pre-recorded puzzles, (3) the amount of time to answer all puzzles (bonus and pre-recorded), and (4) frequency of play. For example, if multiple viewers receive the highest score, then a winner may be determined from among those viewers according to the amount of time taken to solve the bonus puzzles. Successive tiers may be examined according to a variety of criteria until a winner is determined. Other embodiments may employ additional tiers or base the various tiers on different criteria without deviating from the scope or spirit of the invention.

Figure 6:
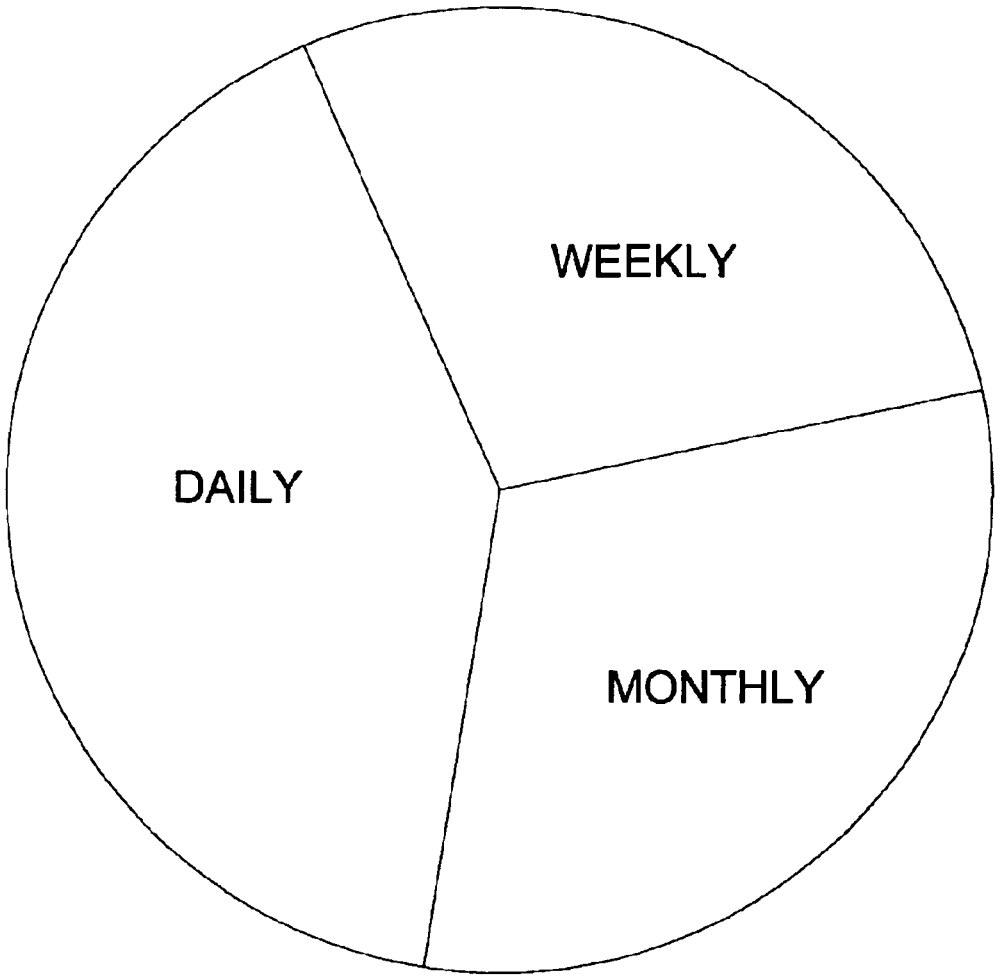
FIG. 6 shows a graph of categories of players in an example embodiment.

Yet further embodiments may employ prizing structures based on other criteria. For example, further embodiments may group viewers into categories and award prizes within each category. These categories may include, for example, frequency of play. In the example embodiment illustrated in FIG. 6, viewers are divided into groups of those who play the game daily, those who play the game weekly, and those who play the game monthly. In some embodiments, for example, the best or most valuable prize may be reserved for the highest scorer in the category of viewers who play every day. Within each category, winners may still be selected according to any of the embodiments discussed above so that the winners are determined within each category sufficiently based on their respective skill.

In other embodiments, viewers may be grouped based on other criteria, such as geographic location. For example, viewers may be grouped based on the time zone in which they play the game. In these embodiments, prizes may be awarded to the highest scorer in each time zone, with the highest scorer being determined according to any of the embodiments discussed above. In further embodiments, viewers may be grouped for prizing purposes based on the jurisdiction in which they play the game. If a particular jurisdiction precludes awarding prizes in a pay-per-game where any component of the game is based on chance, then prizing in that jurisdiction may be based solely on responses to bonus puzzles. Indeed, a prizing structure may be modified to accommodate the laws, policies and/or standards of a particular jurisdiction. Other embodiments may group viewers into categories based on their respective content provider. For example, prizes may be awarded to the highest scorers for each of several cable television providers. In other embodiments, further groupings of viewers may be employed.

Figure 7:
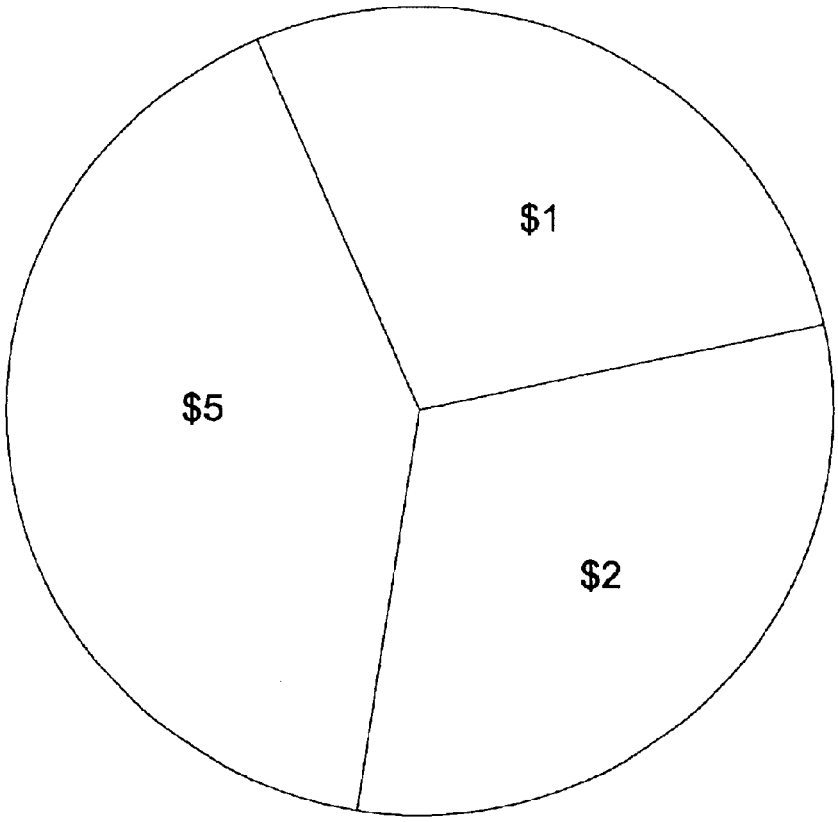
FIG. 7 shows another graph of categories of players in an example embodiment.

In other embodiments, viewers may be grouped according to how much they paid to play a particular game. In the example embodiment illustrated in FIG. 7, viewers are divided into groups of those who pay one dollar to play a game, those who pay two dollars to play a game, and those who pay five dollars to play a game. Winners may be determined for each category as described above with the better or most valuable prizes being reserved for the highest scorers in the highest-paying group. Indeed, other embodiments may employ a variety of categories of viewers without deviating from the scope or spirit of the invention. Moreover, in further embodiments, multiple prizes may be awarded in each category, or more prizes may be awarded in some categories than in others.

In still further embodiments, a prizing structure may incorporate a sweepstakes component. In these embodiments, prizes may be distributed pseudo-randomly within a particular group of players. As illustrated in FIG. 4, a large number of players may correctly solve some, but not all, of the puzzles in a given game. This group of players may be represented in FIG. 4 as falling between lines 4-1 and 4-2. In an example embodiment, prizes may be awarded pseudo-randomly to players who fall into the group between lines 4-1 and 4-2 in FIG. 4. In this embodiment, this large group of players may be motivated to continue playing the game if their score is sufficiently high to qualify them for a sweepstakes component of the prizing. A player's interest may diminish if the player perceives that he or she is not able to compete against players who, for example, fall between lines 4-2 and 4-3 in FIG. 4. Further embodiments may distribute prizes pseudo-randomly within other categories of players.

Although example embodiments above employ a JEOPARDY!® game show format, other embodiments of the invention may employ other game show formats. For example, another embodiment may employs a game show format for WHO WANTS TO BE A MILLIONAIRE®. In this game show format, contestants are asked a series of progressively more difficult questions, the contestants being permitted to advance to the next question only after answering a prior question correctly. A viewer may "play along" with a contestant by, for example, responding to the same questions to which the contestants are called upon to respond. In addition, a sub-pool of bonus questions may be integrated into a broadcast. The sub-pool may be created such that a viewer progresses to successively more difficult questions with each correct answer. In this embodiment, the bonus questions may be more heavily weighted than the pre-recorded questions, with the highest scorer being deemed the winner. In another embodiment, a winner may be selected from among the group of players who answer all of the pre-recorded questions correctly. In this embodiment, the player who receives the highest score on the bonus questions may be deemed the winner.

Further embodiments may employ other game show formats. Virtually any trivia-based game show could be implemented as described above. Other types of game show formats, such as WHEEL OF FORTUNE®, may be employed in further embodiments. In WHEEL OF FORTUNE®, contestants solve word puzzles by guessing which letters comprise a word or phrase. If a contestant guesses a letter that appears in the particular word or phrase, then that letter is displayed where it would appear in the word or phrase. The contestants then guess the word or phrase based on the displayed letters. In an embodiment employing a WHEEL OF FORTUNE® format, bonus puzzles of the same type may be integrated into a broadcast as described above. For example, bonus puzzles may consist of words or phrases with certain letters omitted, with the challenge being for the viewer to guess the word or phrase. In these embodiments, points may be awarded to players based on the number of correct answers, the time taken to input answers, or a combination thereof. Indeed, these embodiments could employ any of the prizing structures described above. Further embodiments may employ other game show formats, such as THE WEAKEST LINK®, HOLLYWOOD SQUARES®, THE PRICE IS RIGHT®, FAMILY FEUD®, or the like, all of which may employ one or more of the prizing structures described above. Further and additional prizing structures may be employed without deviating from the scope or spirit of the invention.

While example embodiments have been described in the context of interactive game shows, other embodiments may involve any contest or competition that consists of multiple sub-contests. For example, embodiments of the invention may be employed in any contest that consists of multiple games of chance and multiple games of skill in which it is desired that the ultimate outcome be deemed sufficiently a game of skill.

The embodiments disclosed herein are to be considered in all respects as illustrative and not restrictive of the invention. The scope of the invention is indicated by the appended claims, rather than the foregoing description. All changes that come within the meaning and range of equivalency of the claims are therefore intended to be embraced therein.

What is claimed is:

1. A method for awarding prizes to contestants in a contest that includes a plurality of sub-contests comprising:

awarding points to contestants based in part on each respective contestant's correct responses to a first set of sub-contests, the first set of sub-contests being a pre-recorded broadcast;

awarding points to contestants based in part on each respective contestant's correct responses to a second set of sub-contests, the second set of sub-contests being a real-time broadcast;

creating a ranking of the contestants based on points awarded to each respective contestant from highest number of points awarded to lowest number of points awarded;

weighting the number of points awarded for each sub-contest so that the ranking approximately correlates to the contestants' performance on the second set of sub-contests; and awarding at least one prize to a contestant based at least in part on the ranking.

2. A method for awarding prizes according to claim 1, wherein the first set of sub-contests are based on chance.

3. A method for awarding prizes according to claim 1, wherein the second set of sub-contests are based on skill.

4. A method for awarding prizes according to claim 1, wherein the contest is an interactive game show.

5. A method for awarding prizes according to claim 4, wherein the first set of sub-contests is broadcasted in more than one time zone.

6. A method for awarding prizes according to claim 1, wherein the contest is an interactive game show, and wherein the second set of sub-contests is broadcasted in a manner such that different sub-contests may be provided to different contestants.

7. A method for awarding prizes according to claim 1, wherein the first set of sub-contests is the same for all contestants and wherein the second set of sub-contests is not the same for all contestants.

8. A method for awarding prizes according to claim 1, wherein the contest is an interactive game show, and wherein the first set of sub-contests are pre-recorded puzzles.

9. A method for awarding prizes according to claim 8, wherein the second set of sub-contests are puzzles that are selected from a puzzle pool such that different puzzles from the puzzle pool may be presented to different contestants.

10. A method for awarding prizes according to claim 1, wherein creating a ranking of the contestants further comprises:

dividing the contestants into sub-groups; and creating a ranking for each sub-group of the contestants in the respective sub-group based on points awarded to each respective contestant from highest number of points awarded to lowest number of points awarded.

11. A method for awarding prizes according to claim 10, wherein the contestants are divided into sub-groups based on each contestant's respective geographic region.

12. A method for awarding prizes according to claim 10, wherein the contestants are divided into sub-groups based on an amount each respective contestant paid to participate in the contest.

13. A method for awarding prizes according to claim 10, wherein the contestants are divided into sub-groups based on a frequency of play for each respective contestant.

14. A method for awarding prizes according to claim 1, wherein awarding at least one prize comprises awarding a prize to a contestant who is awarded the most points.

15. A method for awarding prizes according to claim 10, wherein awarding at least one prize to a contestant based on the ranking comprises awarding a prize to a contestant in each sub-group who is awarded the most points within the respective sub-group.

16. A method for awarding prizes according to claim 10, wherein dividing the contestants into sub-groups is based at least in part on the ranking, and wherein at least one prize is awarded pseudo-randomly to a contestant in a sub-group.

17. A method for awarding prizes according to claim 1, wherein the method further comprises:

charging the contestants to participate in the contest.

18. A method for awarding prizes according to claim 1, wherein creating a ranking of the contestants based on points awarded further comprises ranking contestants who have the same number of points according to a second criterion.

19. A method for awarding prizes according to claim 18, wherein the second criterion is an amount of time taken by each respective contestant to solve the first set of sub-contests.

20. A method for awarding prizes according to claim 19, wherein the second criterion is a number of points awarded to each respective contestant based on the respective contestant's responses to the first set of sub-contests.

21. A method for awarding prizes according to claim 1, wherein the first set of sub-contests are sufficiently available to each respective contestant prior to the contest and the second set of sub-contests are sufficiently unavailable to each respective contestant prior to the contest.

22. A method for awarding prizes according to claim 1, wherein the second set of sub-contests are presented to each respective contestant at specified intervals between the first set of sub-contests.

23. A system for awarding prizes to contestants in an interactive television game show comprising:

a storage medium that stores a pre-recorded game show having pre-recorded puzzles;

a storage medium that stores a pool of bonus puzzles;

an integrating device that integrates at least a portion of the pool of bonus puzzles with the pre-recorded game show to create a combined signal;

a transmitting device that transmits the bonus puzzles in real-time along with the ore-recorded game show;

a plurality of engines that receive the combined signal and present different bonus puzzles in real time to different contestants along with the pre-recorded puzzles; and a response network that receives communications from contestants that are associated with the pre-recorded puzzles and the bonus puzzles and awards points to contestants for correct responses to the pre-recorded puzzles and the bonus puzzles wherein the number of points awarded for the correct responses is weighted to sufficiently insure that a ranking of contestants based on a number of points awarded substantially correlates with a relative performance of the contestants on the bonus puzzles, and wherein the response network determines a contestants to be a prize winner based at least in part on the ranking.

24. A system for awarding prizes according to claim 23, wherein the response network divides the contestants into sub-groups and wherein a contestant in each sub-group is determined to be a prize winner based at least in part on the ranking.

25. A system for awarding prizes according to claim 24, wherein the response network divides the contestants into sub-groups based on each contestant's geographic region.

26. A system for awarding prizes according to claim 24, wherein the response network divides the contestants into sub-groups based on an amount each contestant paid to participate in the contest.

27. A system for awarding prizes according to claim 24, wherein the response network divides the contestants into sub-groups based on a frequency of play for each contestant.

28. A system for awarding prizes according to claim 23, wherein the prize winner is a contestant who was awarded the most points among contestants.

29. A system for awarding prizes according to claim 23, wherein the contestants are charged to participate in the interactive television game show.

30. A system for awarding prizes according to claim 23, wherein the contestants who were awarded the same number of points are ranked according to a second criterion.

31. A system for awarding prizes according to claim 30, wherein the second criterion is an amount of time taken by each contestant to respond correctly to the pre-recorded puzzles.

32. A system for awarding prizes according to claim 30, wherein the second criterion is a number of points awarded to each contestant based on the respective contestant's responses to the pre-recorded puzzles.

33. A system for awarding prizes according to claim 23, wherein the pre-recorded puzzles are sufficiently available to each respective contestant prior to the contest and the at least a portion of the bonus puzzles are sufficiently unavailable to each respective contestant prior to the contest.

34. A system for awarding prizes according to claim 23, wherein the at least a portion of the bonus puzzles are presented to each respective contestant at specified intervals between the pre-recorded puzzles.

* * * * *